United States Patent [19]

Fan et al.

[11] Patent Number: 4,901,533

[45] Date of Patent: Feb. 20, 1990

[54] PROCESS AND APPARATUS FOR THE LIQUEFACTION OF A NATURAL GAS STREAM UTILIZING A SINGLE MIXED REFRIGERANT

[75] Inventors: Chung T. Fan, River Edge, N.J.; Hannes Oelschlegel, Thornwood, N.Y.

[73] Assignee: Linde Aktiengesellschaft, Wiesbaden, Fed. Rep. of Germany

[21] Appl. No.: 842,575

[22] Filed: Mar. 21, 1986

[51] Int. Cl.[4] ..... F25J 3/00

[52] U.S. Cl. ..... 62/11; 62/40

[58] Field of Search ..... 62/9, 11, 40

[56] References Cited

U.S. PATENT DOCUMENTS

| | | | |
|---|---|---|---|
| 3,690,114 | 9/1972 | Swearingen et al. | 62/11 |
| 3,964,891 | 6/1976 | Krieger | 62/9 |
| 3,970,441 | 7/1976 | Etzbach | 62/9 |
| 4,033,735 | 7/1977 | Swenson | 62/9 |
| 4,094,655 | 6/1978 | Krieger | 62/9 |

*Primary Examiner*—Ronald C. Capossela

*Attorney, Agent, or Firm*—Millen, White & Zelano

[57] ABSTRACT

In a process for cooling gas fluid feed material from an initial temperature to a second, cryogenic temperature which utilizes a single mixed refrigerant composition whose respective constituents possess a range of successively lower boiling points, wherein said refrigerant composition is passed through a single closed loop refrigeration cycle involving compression, partial condensation in an aftercooler phase separation, heat exchange and expansion, wherein heat exchange occurs in a cold box containing a warm end and a cold end heat exchanger, said exchangers being thermally connected in series relationship, wherein the improvement comprises regulating the flow rate of the vapor-containing refrigerant stream passing from said partial condensation stage by diverting predetermined amounts of liquid refrigerant from the liquid-containing refrigerant stream, also passing from said partial condensation stage, into said vapor-containing stream, said diverting occurring at a point inside the cold box after said vapor-containing stream exits the warm end heat exchanger, but before it enters the cold end heat exchanger. Apparatus to accomplish the process is also disclosed.

37 Claims, 1 Drawing Sheet

PROCESS AND APPARATUS FOR THE LIQUEFACTION OF A NATURAL GAS STREAM UTILIZING A SINGLE MIXED REFRIGERANT

BACKGROUND OF THE INVENTION

1. Field of the Invention

This invention relates to a process and accompanying apparatus for the liquefaction of gaseous hydrocarbons, such as natural gas, by an improved single mixed refrigerant process, and more particularly relates to such a process, the capacity of which is easily and economically adaptable to changes in environmental ambient temperature while requiring only insignificant additional power requirements.

2. Description of the Prior Art

Since the discovery of the cryogenic gas liquefaction process by Karl Von Linde in 1895, a variety of such processes have been developed for the liquefaction of hydrocarbons, particularly for hydrocarbons such as natural gas. Such processes are frequently carried out at the site of the gas recovery.

Natural gas is being utilized as a fuel in ever increasing amounts in recent years. As the population of large metropolitan areas increases, the utilization of natural gas as a heating medium for these large cities has become, like other power sources, extremely volatile due to the particular seasonal demand. Natural gas is utilized primarily during winter for domestic heating and the like, and its use naturally falls off drastically during the warm summer months. In an attempt to smooth out such natural gas demand fluctations, a number of LNG (liquid natural gas) peak shaving plants are now being employed. Such systems typically liquefy the natural gas between the months of April and October, storing the LNG in enormous, flat-bottom storage tanks, typically kept by necessity at around atmospheric pressure, and then during peak demand season in the cold weather, vaporize and utilize the LNG.

Since these peak shaving plants are typically operated only about 200–220 days a year and have a much smaller capacity as compared to the large, so-called "base-load" plants present at the source of gas production, economic factors involving both their construction and ease of operation are even more important than usual. Consequently, the classic cascade process, which utilizes nine separators and three compressors, is simply too expensive for utilization as a peak shaving unit. In 1959, A. P. Klemenko (Refrigeration Congress, 959, Copenhagen) disclosed a process for employing a mixture of refrigerants in conjunction with a single compressor and a simplified cascade process. A number of mixed refrigerant processes have also been developed by the art, such as U.S. Pat. Nos. 3,218,816, 3,581,511 and U.S. Pat. No. 3,364,685.

U.S. Pat. No. 4,033,735 discloses the so-called Prico Process, involving a single stage compression operation in which the resulting vapor and liquid streams which leave the aftercooler separator are combined outside the cold box before entering into the warm end heat exchanger. Also, the process does not provide for a separation of a refrigerant mixture during the entire heat exchange with the natural gas feedgas, and thus cannot be considered a cascade cycle.

Recently, the art has begun to utilize a single mixed refrigerant cycle containing two refrigerant separators for the simplified cascade process, one such separator utilized for the aftercooler separator and one for the cold box separator. This process has become popular because it is more efficient than the Prico Process of U.S. Pat. No. 4,033,735, for it is able to more efficiently match the particular refrigerant mixtures to the required temperature levels. A number of processes which use a single mixed refrigerant system, typically 4–6 refrigerant components, are described in, for example, LNG Information Book, July 1968, Amer. Gas Assoc., Inc., New York, N.Y.; "Modified Cascade Cycle", pp. 25–27 (July, 1968), or, Linde Reports on Science & Technol. (Linde, A. G., Vol. 32, (1981), p. 19–28, "Liquefaction of Natural Gas with Aid of Refrigerant Mixtures", Hans-Robert Zollner). These processes are more efficient than the other simplified processes such as the $N_2/CH_4$ expander cycle, because due to the absence of an expander they are able to condense part of the refrigerant mixture, utilizing ambient air or cooling water as the cooling fluid. However, these systems are hampered by a problem not common to the other refrigeration processes, that is, the temperature of the aftercooler separator must be kept constant once it is designed, regardless of the particular environmental ambient temperature of the cooling fluid utilized by the aftercooler. If the percentage of refrigerant which is condensed in the compressor aftercooler should vary from the process design, one of the heat exchanger units in the cold box will be unable to carry out its refrigeration duty. This is because, in the conventional process, the vapor fraction from the aftercooler separator has been designed to supply the refrigeration duty of the cold end heat exchanger and the liquid fraction from the aftercooler separator is utilized to supply the refrigeration of the warm end exchanger. Consequently, when the ambient temperature falls, since the percentage amounts of liquid and vapor separated in the aftercooler separator remain constant, and the unit remains at the same temperature, only very small benefits are derived from this change. In such systems, a significant amount of additional condensation of the refrigerant mixture does not occur in the aftercooler unit. Thus, modifying the two separator-three heat exchanger-mixed refrigerant process, to enable an improved flexibility in adapting to the temperature of the ambient air, is both difficult and expensive.

The Prico Process is more adaptable than the aforementioned conventional single mixed refrigerant process which utilizes multiple separators, since it does not utilize the vapor and liquid fractions leaving the aftercooler separator in a separate fashion. However, the process utilizes only 20–40° F. of the superheating of the refrigerant which leaves the cold box, and thus is only able to obtain a maximum liquefaction capacity increase of about 5% due to the lowering of the ambient temperature.

As a result, the art has been forced to design LNG peak shaving plants that employ as the design ambient temperature the highest temperature usually occurring during the summer season of the particular local, which is frequently about 20–30° F. above the average ambient temperature over the 200 day operating season. Consequently, such a design not only requires a larger compressor, but also results in high operating costs.

OBJECTS OF THE INVENTION

Accordingly, an object of one aspect of the invention is to provide an improved single mixed refrigerant process.

Another particular aspect of another object of the invention is to provide a process which effectively utilizes the ambient air temperature, when lower than the design temperature, to obtain additional condensation of the higher boiling point refrigerant fraction in the aftercooler separator, thereby enabling an increased capacity for natural gas liquefaction without additional compressor power requirements.

Another object of still another aspect of this invention is to provide apparatus to accomplish the processes.

Upon further study of the specification and appended claims, further objects and advantages of this invention will become apparent to those skilled in the art.

SUMMARY OF THE INVENTION

Accordingly, these and other process aspects of the invention have been attained, in a process for cooling a fluid feed material from an initial temperature to a second, cryogenic temperature which utilizes a single mixed refrigerant composition whose respective constituents possess a range of successively lower boiling points, wherein said refrigerant composition is passed through a single closed loop refrigeration cycle involving compression, partial condensation in an aftercooler, phase separation, heat exchange and expansion, wherein heat exchange occurs in a cold box containing a warm end and a cold end heat exchanger, said exchangers being thermally connected in series relationship, wherein the improvement comprises regulating the flow rate of the vapor-containing refrigerant stream passing from said partial condensation stage by diverting predetermined amounts of liquid refrigerant from the liquid-containing refrigerant stream, also passing from said partial condensation stage, into said vapor-containing stream, said diverting occurring at a point inside the cold box after said vapor-containing stream exits the warm end heat exchanger but before it enters the cold end heat exchanger. (Generally, when the ambient temperature is not below the design temperature, it is unnecessary to divert any liquid refrigerant.)

By such a process it is possible to increase the utilization of the increased refrigeration, obtained from decreases in the ambient temperature of the aftercooler cooling fluid, below the design temperature, which results in a greater amount of liquid refrigerant condensed in the aftercooler separator. This condensed refrigerant is then eventually diverted, through utilization of a controlled valve, in such a manner to maximize the refrigerant capacity of the process.

With respect to the apparatus to which the invention is directed, the apparatus includes a cold box having warm end and cold end heat exchangers therein with a compressor and a phase separator disposed outside of the cold box. The phase separator is connected to the cold box by vapor and liquid lines. The vapor line loops through the warm end and cold end heat exchangers while the liquid line terminates between the heat exchangers and is connected, via an expansion valve, to the vapor line downstream of the cold end heat exchanger. The improvement contemplates configuring the apparatus to compensate for excess liquid in the liquid line without utilizing a phase separator in the cold box. This is accomplished by connecting the liquid line to the vapor line with a variable flow valve upstream of the cold end heat exchanger to divert excess liquid from the liquid line to the vapor line.

BRIEF DESCRIPTION OF THE DRAWINGS

Various other objects, features and attendant advantages of the present invention will be more fully appreciated as the same becomes better understood when considered in connection with the accompanying drawing, wherein.

DETAILED DESCRIPTION

Figure 1:
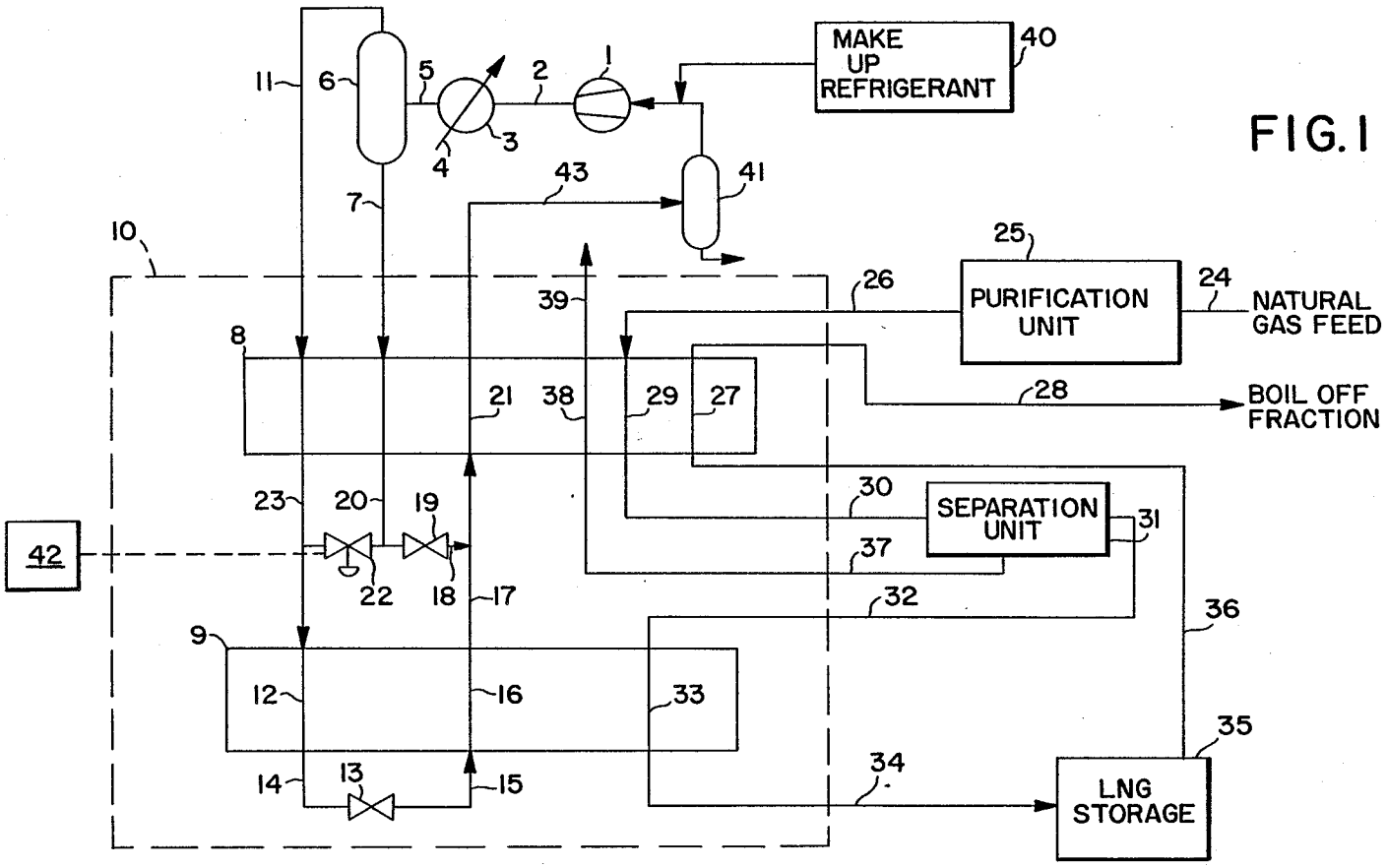
FIG. 1 is a simplified schematic flowsheet of a preferred embodiment of the closed loop, single mixed refrigerant process of this invention.

The improved process of the invention features the discovery that by regulating, preferably continuously, the relative amounts of refrigerant present in the liquid and vapor streams exiting the warm end heat exchanger, i.e., preferably by effectively utilizing a valve means whose operation is controlled by an effective controller mechanism, an increased capacity for natural gas liquefaction without additional compressor power requirements is obtained. Preferably, one continually readjusts the amount of refrigerant present in the line which contains the liquid refrigerant which has been condensed in the after-cooler separator; such readjustment necessitated by the changing, in the aftercooler, of the temperature of the cooling medium (e.g., air, $H_2O$) which cools the refrigerant, and which refrigerant later enters the warm end heat exchanger. This valve means or "diverting" valve, positioned inside the cold box, is a control valve which is preferably controlled by a suitable vapor-liquid-ratio controller, i.e., a computing means in conjunction with thermal, pressure, and flow measuring means positioned strategically throughout the system, i.e., preferably on the vapor and liquid streams leaving the aftercooler separator and on the returning refrigerant line from the cold box, e.g., at a point after the refrigerant exits the compressor. Preferably, the resulting system monitors, i.e., continually measures and then corrects, through a regulating of the operation of the diverting valve to see that the ratio of the amounts of (1) refrigerant flowing into the cold end heat exchanger and (2) refrigerant flowing from the warm end exchanger, remain substantially constant. This constant ratio must additionally reflect variations resulting from the aftercooler cooling fluid ambient temperature and also the refrigerant mixture compositions, i.e., it must enable the low temperature refrigerant fractions such as nitrogen and methane to pass to the cold end heat exchanger. The precise amount of "diverting" of the liquid refrigerant which is obtained in subcooled form from the warm end exchanger is slightly larger than the excess amount of condensation which occurs in the aftercooler separator. (A small fraction of the higher boiling point refrigerant components, e.g., ethylene or isobutane, will be also added in this manner and the resulting temperature difference that occurs between the warm end heat exchanger and the cold end heat exchanger will decrease once the refrigerant mixture enters the cold box at a lower temperature.) When the temperature of the incoming refrigerant into the cold box falls, the temperature between the cold and warm end heat exchangers drops and this factor, together with an increased refrigerant flow rate present in the compressor, will change the refrigeration duty ratio between the two cold box heat exchangers. This ratio, which typically ranges from about 2.2:1 to 1.8:1 for the warm end versus cold end exchangers, will be changed slightly, e.g., about 1% for each degree of the ambient temperature drop of the aftercooler cooling fluid.

Diverting the excess liquid refrigerant condensate at a point in the process wherein the refrigerant streams are positioned inside the cold box between the two heat exchangers, instead of, e.g, before entering into the cold box, has a number of unexpected advantages. At this point in the process the vapor stream has cooled sufficiently to contain a substantial amount of liquid, and thus liquid to liquid mixing is involved. The original liquid condensate line from the aftercooler separator has a hydraulic head of about 20 feet of pressure, whereas the vapor line possesses only a very small hydraulic head; thus, the resulting pressure difference between the two streams is sufficient to provide the necessary pressure differential for the utilization of the diverting valve, without the requiring of a liquid pump.

A particularly important advantage of the invention is the elimination of the use of a refrigerant separator unit in the cold box between the warm and cold end heat exchangers, which not only reduces the inventory of the refrigerant mixture in the refrigeration loop, but more importantly, eliminates any consideration involving the maintenance of a proper split of the vapor/liquid streams in the cold separator, thereby making the design of an ambient temperature-dependent process feasible. In essence, the elimination of the refrigerant separator in the cold box greatly simplifies operations, as well as enabling the improved design embodied by the process of the invention, which, preferably, employs only a single warm end and a single cold end heat exchanger, in contrast to the prior art. Although only two heat exchangers in series within the cold box are preferred, in the broadest embodiment a greater number, e.g., 3, 4 or more heat exchangers may also be utilized within the cold box without requiring additional gas-liquid separation apparatus. Additionally, the complex apparatus piping connections required by the two cold end heat exchangers which are found in the conventional single mixed refrigerant process are eliminated, and the physical size requirements of the cold box is thus substantially decreased, e.g., as much as about 30%. Additionally, the adjusting of the refrigerant makeup composition by plant operating personnel is also greatly simplified. Another advantage of the process of the invention is to allow the precise heat requirements, i.e., duties, of the two cold box heat exchangers to be easily kept in their proper ratios.

The increase in liquefaction capacity of the process results from the fact that the temperature of the refrigerant stream which returns to the compressor can be at a much lower temperature, e.g., about 1 to 25° F., than is typically designed. When the suction temperature of the refrigerant entering the compressor decreases, the compressor can process a corresponding higher volume of refrigerant, without requiring any additional power. Preferably, the exact increase in refrigerant molar flow is slightly less than the ratio of absolute temperatures for the inlet gases, since at lower suction temperatures, the molar heat capacity of the refrigerant mixture is slightly lower and at the new, higher flow rate, compressor efficiency also drops very slightly. However, it is clear that a substantial improvement is created. Although an increased rate of refrigerant passing through the compressor unit will not increase the thermal requirements of the aftercooler separator, since the compressed gas stream enters at a sufficiently lower temperature, an extra amount, e.g., 1–25% of heat transfer surface in the aftercooler will be required due to the increased flow rate of refrigerant and feed gas. Also, by providing a greater amount of heat transfer area in the cold box heat exchangers, e.g., about 1 to 25%, the maximum liquefaction capacity of the plant is also correspondingly increased when the ambient temperature of the surrounding environment goes down. Thus, the process of the invention can enable the design of LNG liquefaction plants which are designed for operation at ambient temperature to slightly higher, e.g., preferably, for operation at a temperature which is 20% of the difference between average ambient and the maximum temperature, than the average ambient temperature of the entire operating season for the particular environment, yet still possess the same total amount of annual liquefaction capacity. For example, if the maximum temperature in an area is 100° F., and average ambient temperature is 70° F., the plant can be designed to operate at a temperature of 76° F.

The apparatus suitable for use in the process may be adapted for cooling a variety of refrigerants throughout a temperature range from about +300° F. to −320° F. Both for simplicity and to increase the clarity of the description of the process, it is assumed that the apparatus utilized is adapted for liquefying a dry natural gas input containing primarily methane, but also substantially smaller amounts of nitrogen and $C_2$ through $C_6$ hydrocarbons. The exact composition of a typical natural stream requiring liquefaction is detailed in the later description of a preferred embodiment of the process.

The process of the invention can utilize either single stage compression for the refrigerant, or a two stage compression unit possessing an intercooler for the refrigerant which is being recycled. Usually two stage compression is used when power is relatively expensive, or when the compressor requires a gas turbine, or the like. When single stage compression is used, the discharge pressure is usually between about 360–520 psia, and when two stage compression operation is utilized, the discharge pressure ranges between about 540–700 psia.

The capacity of the resulting process increases as the ambient air temperature decreases because when this occurs, the temperature of the refrigerant exiting the cold box is lower than before, thereby enabling the processing of a greater molar flow rate of refrigeration without requiring additional power. For example, when the ambient temperature drops about 18° F., the resulting capacity of the liquefaction facility, using single stage compression, is about 8.5% greater than the regular two-separator process, without requiring any additional power. In the same example involving a two stage compression, the precise amount of capacity increase is slightly less, due to the requirements presented by the compressor intercooler. A ceiling on the ultimate maximum capacity increase of the process exists, i.e., so as to ensure that the refrigerant stream which leaves the cold box will be fully vaporized in the warm end heat exchanger, thereby insuring that there will be no separation in the suction separator unit. Utilizing conventional refrigerant compositions suitable for usage in the process, about 15% increases in the maximum capacity for the single stage compression unit may be possible as compared to the regular two stage separator process.

The refrigerant mixture suitable for usage preferably contains about 4–6 components of the following compounds, e.g., about 2–15 mole% nitrogen, about 20–45 mole% methane, about 20–40 mole% $C_2$ (ethylene or ethane), about 0–15 mole% $C_3$ (propane or propylene), about 0–35 mole % $C_4$ (isobutane or N-butane), and about 0–15 mole% $C_5$ (isopentane or N-pentane).

With respect to the details of the apparatus aspect of this invention, involving apparatus suitable for the liquefaction of a natural gas stream and including compressor means, aftercooler means, phase separation means and a cold box, the improvement comprises:

the cold box having no phase separator therein;

a warm end heat exchanger and a cold end heat exchanger disposed within the cold box;

a first expansion valve disposed in the cold box but outside of the cold end heat exchanger;

a second expansion valve disposed in the cold box between the warm end and cold end heat exchangers;

refrigerant line means connected to the phase separation means, the refrigerant line means including a vapor line and a liquid line both extending from the phase separation means and through the cold box for transporting refrigerant fluid through the cold box without passing through a phase separator in the cold box; the vapor refrigerant line extending through the warm end heat exchanger and cold end heat exchanger, through the first expansion valve, back through the cold end and warm heat exchangers and to the compressor means; the liquid line extending through the warm end heat exchanger and being connected to the vapor line through the second expansion valve;

an adjustable flow valve in the cold box, the adjustable flow valve being disposed between the warm end and cold end heat exchangers and connected between the liquid line and vapor line upstream of the second expansion valve for flowing excess liquid from the liquid line to the vapor line; and means connected to the adjustable flow valve for adjusting the adjustable flow valve to control the rate of fluid flow therethrough.

In a further embodiment, the invention includes apparatus which further includes means, completely external of the cold box, for connecting the compressor means, aftercooler means and phase separator means to one another.

In a further embodiment, the invention includes apparatus wherein the connecting means completely external of the cold box is insulated.

In a further embodiment, the invention includes apparatus wherein the aftercooler means includes means associated therewith for cooling the aftercooler means with ambient air.

In a further embodiment, the invention includes apparatus wherein the apparatus further includes means for monitoring the temperature, pressure and flow rate of the refrigerant in the refrigerant line means at at least two locations, the locations including a first location in the vapor line upstream of the adjustable flow valve and a second location downstream of the second expansion valve.

In a further embodiment, the invention includes apparatus wherein the apparatus further includes means connected to the adjustable valve means and to the monitoring means for controlling the adjustable valve and thus the rate of flow therethrough as a function of the temperatures, pressures and flow rates sensed by the monitoring means.

In a further embodiment, the invention includes apparatus wherein the monitoring means further includes supplemental monitoring means in the liquid flow line upstream of the adjustable flow valve and second expansion valve for monitoring the temperature, pressure and flow rate therein and means for connecting the supplemental monitoring means to the controlling means.

In a further embodiment, the invention includes apparatus further including a suction separator disposed in the connecting means upstream of the compressor means.

In a further embodiment, the invention includes apparatus wherein the apparatus further includes means for monitoring the temperature, pressure and flow rate of the refrigerant in the refrigerant line means at at least two locations including a first location in the vapor line upstream of the adjustable flow valve and a second location downstream of the second expansion valve.

In another embodiment, the invention includes apparatus wherein the apparatus further includes means connected to the adjustable valve means and to the monitoring means for controlling the adjustable valve and thus the rate of flow therethrough as a function of the temperatures, pressures and flow rates sensed by the monitoring means.

In another embodiment, the invention includes apparatus wherein the monitoring means further includes supplemental monitoring means in the liquid flow line upstream of the adjustable flow valve and second expansion valve for monitoring the temperature, pressure and flow rate therein and means for correcting the supplemental monitoring means to the controlling means.

In another embodiment, the invention includes apparatus wherein there are only two heat exchangers within the cold box and wherein the compressor means, aftercooler means and phase separator means are disposed outside of the cold box and connected to one another via an insulated line.

In another embodiment, the invention includes apparatus further including means associated with the aftercooler means for cooling refrigerant flowing through the aftercooling means with ambient fluid.

In another embodiment, the invention includes apparatus wherein the ambient fluid is ambient air.

With respect to details of an additional apparatus aspect of the invention involving cooling apparatus and includes: a cold box having warm end and cold end heat exchangers therein; at least one compressor means and phase separation means external of the cold box; and refrigerant line means extending from the phase separation means through the warm end and cold end heat exchangers in the cold box, the refrigerant line means including a vapor line and a liquid line, the improvement comprising:

the cold box not having a phase separator therein; first and second expansion valves in the cold box, the first expansion valve being disposed outside of the cold end heat exchanger and the second expansion valve being disposed between the warm end and cold end heat exchangers; the vapor line extending through the warm end heat exchanger and cold end heat exchanger, through the first expansion valve, back through the cold and warm end heat exchangers and to the compressor means; the liquid line extending from the phase separation means and through the warm end heat exchanger; an adjustable flow valve in the cold box disposed between the warm end and cold end heat exchangers and connected directly between the liquid line and vapor line upstream of the second expansion valve; means connected to the adjustable flow valve for adjusting the adjustable flow valve to control the rate of fluid flow therethrough, whereby excess liquid in the liquid line is conveyed to the vapor line and compensated for in the apparatus without using a phase separator in the cold box.

In another embodiment, the invention includes apparatus further including means, completely external of the cold box, for connecting the compressor means, aftercooler means and phase separator means to one another.

In another embodiment, the invention includes apparatus wherein the connecting means completely external of the cold box is insulated.

In another embodiment, the invention includes apparatus wherein the aftercooler means includes means associated therewith for cooling the aftercooler means with ambient air.

In another embodiment, the invention includes apparatus wherein the apparatus further includes means for monitoring the temperature, pressure and flow rate of the refrigerant in the refrigerant line means at at least two locations including a first location in the vapor line upstream of the adjustable flow valve and a second location downstream of the second expansion valve.

In another embodiment, the invention includes apparatus wherein the apparatus further includes means connected to the adjustable valve means and to the monitoring means for controlling the adjustable valve and thus the rate of flow therethrough as a function of the temperatures, pressures and flow rates sensed by the monitoring means.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the preceding text and the following examples, all temperatures are set forth uncorrected in degrees Fahrenheit and all parts and percentages are by weight; unless otherwise indicated.

EXAMPLE 1

In FIG. 1, a simplified schematic flowsheet of the liquefaction section of a LNG peak shaving plant is disclosed. It is further to be understood that a number of conventional accompanying stages, such as prepurification of the natural gas feed and removal of the heavy constituent of the feed gas between the warm end heat exchanger and the cold end heat exchanger are either not discussed, or briefly mentioned, in the diagram.

A refrigeration mixture comprising

| | | |
|---|---|---|
| methane | 34.2 | mol % |
| ethylene | 31.0 | |
| isobutane | 28.4 | |
| nitrogen | 6.4 | |
| | 100.0 | |

is compressed by recycle compressor 1 to 480 psia and 338° F. This stream passes through conduit 2 into cooling unit, i.e., aftercooler 3, where it is cooled to 97° F. by thermal contact with either an air or cooling water stream which is maintained at the outside, or environmental, ambient temperature, which is 79° F. Approximately 18% of the refrigerant is condensed in the aftercooler. The condensate, comprising primarily the high boiling point compounds, e.g., ethylene and isobutane, together with small amounts of methane and nitrogen, is separated from the remaining refrigerant vapor after flowing through conduit 5 into aftercooler phase separator 6. The aftercooler separator separates the refrigerant into liquid (18%) and vapor (82%) phases, with the resulting liquid condensate passing through conduit 7 into warm end heat exchanger 8, at 97° F. which, together with cold end heat exchanger 9, are inside cold box 10. Additionally, the vapor from separator 6, primarily comprising the low boiling compounds, passes through line 11 and also enters into heat exchanger 8 at 97° F. wherein which most of the refrigerant vapor becomes condensed while passing through unit 8 and, after exiting in line 23, eventually enters cold end heat exchanger 9 in line section 12 at −105° F. Upon exiting exchanger 9, the stream is completely liquefied, being subcooled to −235° F. The supercooled liquid refrigerant is then flashed through, a first expansion valve, Joule-Thompson valve 13 on conduit 14 and exits at 80 psia and −240° F. The refrigerant then returns to cold end heat exchanger 9 in conduit segment 15, and in conduit 16 provides the necessary refrigeration for the cold end heat exchanger 9. The now warmed refrigerant, exiting at 2 to 20° F. colder than the temperature of incoming line 23 in segment 17, is then mixed with condensate stream 18 which has been flashed through a second expansion valve, JT valve 19, from conduit 20, and with the pressure of lines 18 and 17 becoming equalized, are thus mixed together and enter warm end exchanger 8 in line segment 21. During such flow, diversion valve 22, which is a typically constructed variable flow valve such as, for example, a Globe Control Valve fabricated from aluminum or stainless steel, by Kammer Valves, Inc. is closed. The liquid fraction of the refrigerant stream in conduit 21 is primarily condensate from aftercooler separator 6, together with some vapor which has been mixed and superheated in the warm end heat exchanger 8, to provide the refrigeration for the exchange.

Natural gas feedstream 24, comprising which has removed its $CO_2$, water and several other desired impurities in prepurification unit 25, enters warm end heat exchanger 8 in conduit 26 at 82° and 250 psia. In segment 29, the heavy fraction, e.g., primarily $C_{5+}$ components, are condensed, while the resulting natural gas stream exits the cold box in conduit 30 and is then passed to separation unit 31, which may be a knock-out drum, or a distillation column for heavys removal or nitrogen removal, similar systems being utilized, for example, in U.S. Pat. No. 4,033,735, and which form no essential part of the invention. After exiting unit 31, the remaining natural gas vapor enters cold end heat exchanger 9 through conduit 32 at −105° F., the same temperature of the fluids in lines 20 and 23, and in line segment 33 the natural gas is completely liquefied and subcooled to −235° F., whereupon it exits the cold box end 34 at 15.4 psia, and is fed to the LNG storage tank 35.

A separate vapor stream 36, comprising a mixture of cold boil-off gas, displaced gas resulting from the decreases in gas volume in the LNG tank occurring from the entry of LNG therein, and flash gas from the LNG storage tank, enters warm end heat exchanger 8 and in line segment 27 is warmed up to 91° F., prior to, e.g., exiting in line 28 to be compressed by boil-off compressors (not shown) or otherwise utilized, such as fuel for the plant. This stream is of variable composition, as would be apparent to one skilled in the art.

A separate heavys fraction, from either a separator or distillation column (not shown), re-enters warm end heat exchanger 8 in segment 38 from conduit 37, and exits the cold box end segment 39 at 91° F.

EXAMPLE 2

This example illustrates the operation of the process when the ambient temperature of the aftercooler cooland drops below the designed value, for example, from about 79° F. to 61° F. The resulting refrigerant mixture, having any incidental losses replenished with fresh refrigerant from makeup unit 40, passes from suction separator unit 41 at about 38° F., containing a 10.5% increase in molar flow rate than in Example 1. In single stage compressor 1, the refrigerant is compressed to 480 psia and 267° F. After being cooled to 79° F. in aftercooler 3, 25.6% of the refrigerant stream is condensed and separated as liquid in aftercooler separator 6. The resulting condensate stream 7 passes through the cold end exchange 8 and is cooled down to −107° F., at which point 32.2% of the resulting liquid in stream 20 is diverted to mix into vapor line 23 by passing through valve 22, which automatically adjusts to monitor then precise liquid refrigerant flow rate which enters vapor stream 23 from liquid stream 20. The movements of valve 22 are controlled by control unit 42, which is preferably a computing means adapted for high speed electronic processing of the flow rate, pressure, and temperature data gathered by sensors measuring the volumetric flow, pressures and temperatures in lines 11 and 12, and then relay this data to controller 42. Such detailed process control controllers and measuring sensors are well known to those in the art. The remaining condensate which is not diverted to line 23 is flashed through valve 19 and mixed with the returning refrigerant from the cold end heat exchanger in line 17, lines 18 and 17 being at the same pressure. The resulting stream exits the cold box in line 43 at 37° F. Natural gas feedstream 24, having a 7.7% greater molar flow rate than in Example 1, is liquefied and then separated from its heavys fraction in the cold box as before. The boil-off containing fraction 36 from the LNG storage tank is also warmed in the cold box as is before, and exits cold box 8 at 37° F. as does the refrigerant mixture in line 43 and the heavy fraction in line 39.

By way of definition, a Joule-Thomson valve is a valve through which a liquid, gas, or liquid-gas mixture is allowed to expand adiabatically, and results in a lowering of its temperature. Such expansion valves can be obtained, e.g., from Fisher Controls, Inc., Marshalltown, Iowa.

Also, the "cold box," a term well known in the art, is defined as an insulated arrangement of cryogenic apparatus which cools fluids to cryogenic temperature levels, e.g., down to about −50° F. to −320° F. and below.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for cooling a fluid feed material from an initial temperature to a second, cryogenic temperature which utilizes a single mixed refrigerant composition whose respective constituents possess a range of successively lower boiling points, wherein said refrigerant composition is passed through a single closed loop refrigeration cycle involving stages of: compression; partial condensation in an aftercooler; phase separation to provide a vapor-containing refrigerant stream and a liquid-containing refrigerant stream; heat exchange; and expansion, wherein the heat exchange occurs in a cold box containing a warm end and a cold end heat exchanger, said exchangers being thermally connected in series relationship, wherein the improvement comprises regulating the flow rate of the vapor-containing refrigerant stream passing from said partial condensation stage by diverting predetermined amounts of liquid refrigerant from the liquid-containing refrigerant stream also passing from the partial condensation stage, into said vapor-containing refrigerant stream, said diverting occurring at a point inside the cold box after said vapor-containing refrigerant stream exits the warm end heat exchanger, but before entering the cold end heat exchanger.

2. A process according to claim 1, wherein said mixed refrigerant composition comprises about 4–6 refrigerant components.

3. A process according to claim 1, wherein said cold box consists essentially of a simple warm end and a single cold end heat exchanger and without the presence of a refrigerant separator unit therein.

4. A process according to claim 1, wherein the regulating of the vapor-containing refrigerant stream is accomplished in a substantially continuous manner.

5. A process according to claim 1, wherein said liquid refrigerant from the liquid-containing refrigerant stream is diverted to said vapor-containing refrigerant stream by an effective flow control means regulated by a controller unit.

6. A process according to claim 5, wherein the flow control means is a control valve.

7. A process according to claim 1, wherein the cooling fluid utilized in the partial condensation stage in the aftercooler separator is air or water, each maintained at the ambient temperature of the surrounding environment.

8. A process according to claim 1, wherein the ratio of refrigerant duties of the cold end and warm end heat exchangers is kept substantially constant during said process.

9. A process according to claim 8, wherein said constant ratio of refrigeration duties ranges from about 2.2–1.8 to 1 for the warm end to cold end heat exchangers.

10. A process according to claim 1, wherein the diverting of refrigerant from the liquid stream to the vapor stream occurs without the presence of a liquid pump.

11. A process according to claim 1, wherein the process enables a reduction in size of the cold box from about 1 to 30%.

12. A process according to claim 1, wherein the compression unit is a single stage compressor.

13. A process according to claim 1, wherein said compression unit involves a two stage compressor with an intercooler.

14. A process according to claim 1, wherein said fluid feed material is natural gas.

15. A process according to claim 1, wherein the ratio of the flow rates into the cold end heat exchanger to the flow rate out of the warm end heat exchanger is substantially constant.

16. A process according to claim 1, wherein said refrigerant is cooled from about 300° F. to −320° F.

17. A process according to claim 1, wherein said regulating is accomplished by continually measuring the temperature, pressure and flow rates of said vapor-refrigerant stream leaving the cold box, utilizing said measured data to formulate said predetermined amount of liquid refrigerant to be diverted by means of a controller, and diverting said amount of liquid refrigerant.

18. An apparatus suitable for the liquefaction of a natural gas stream, the apparatus including compressor means, aftercooler means, phase separation means and a cold box, the improvement comprising:

the cold box having no phase separator therein;

a warm end heat exchanger and a cold end heat exchanger disposed within the cold box;

a first expansion valve disposed in the cold box but outside of the cold end heat exchanger;

a second expansion valve disposed in the cold box between the warm end and cold end heat exchangers;

refrigerant line means connected to the phase separation means, the refrigerant line means including a vapor line and a liquid line both extending from the phase separation means and through the cold box for transporting refrigerant fluid through the cold box without passing through a phase separator in the cold box; the vapor refrigerant line extending through the warm end heat exchanger and cold end heat exchanger, through the first expansion valve, back through the cold end and warm heat exchangers and to the compressor means; the liquid line extending through the warm end heat exchanger and being connected to the vapor line through the second expansion valve;

an adjustable flow valve in the cold box, the adjustable flow valve being disposed between the warm end and cold end heat exchangers and connected between the liquid line and vapor line upstream of the second expansion valve for flowing excess liquid from the liquid line to the vapor line; and means connected to the adjustable flow valve for adjusting the adjustable flow valve to control the rate of fluid flow therethrough.

19. The improvement of claim 18, further including means, completely external of the cold box, for connecting the compressor means, aftercooler means and phase separator means to one another.

20. The improvement of claim 19, wherein the connecting means completely external of the cold box is insulated.

21. The improvement of claim 20, wherein the aftercooler means includes means associated therewith for cooling the aftercooler means with ambient air.

22. The improvement of claim 21, wherein the apparatus further includes means for monitoring the temperature, pressure and flow rate of the refrigerant in the refrigerant line means at at least two locations, the locations including a first location in the vapor line upstream of the adjustable flow valve and a second location down stream of the second expansion valve.

23. The improvement of claim 22, wherein the apparatus further includes means connected to the adjustable valve means and to the monitoring means for controlling the adjustable valve and thus the rate of flow therethrough as a function of the temperatures, pressures and flow rates sensed by the monitoring means.

24. The improvement of claim 23, wherein the monitoring means further includes supplemental monitoring means in the liquid flow line upstream of the adjustable flow valve and second expansion valve for monitoring the temperature, pressure and flow rate therein and means for connecting the supplemental monitoring means to the controlling means.

25. The improvement of claim 20, further including a suction separator disposed in the connecting means upstream of the compressor means.

26. The improvement of claim 18, wherein the apparatus further includes means for monitoring the temperature, pressure and flow rate of the refrigerant in the refrigerant line means at at least two locations including a first location in the vapor line upstream of the adjustable flow valve and a second location downstream of the second expansion valve.

27. The improvement of claim 26, wherein the apparatus further includes means connected to the adjustable valve means and to the monitoring means for controlling the adjustable valve and thus the rate of flow therethrough as a function of the temperatures, pressures and flow rates sensed by the monitoring means.

28. The improvement of claim 27, wherein the monitoring means further includes supplemental monitoring means in the liquid flow line upstream of the adjustable flow valve and second expansion valve for monitoring the temperature, pressure and flow rate therein and means for correcting the supplemental monitoring means to the controlling means.

29. The improvement of claim 18, wherein there are only two heat exchangers within the cold box and wherein the compressor means, aftercooler means and phase separator means are disposed outside of the cold box and connected to one another via an insulated line.

30. The improvement of claim 29, further including means associated with the aftercooler means for cooling refrigerant flowing through the aftercooling means with ambient fluid.

31. The improvement of claim 30, wherein the ambient fluid is ambient air.

32. In a cooling apparatus wherein the cooling apparatus includes: a cold box having warm end and cold end heat exchangers therein; at least one compressor means and phase separation means external of the cold box; and refrigerant line means extending from the phase separation means through the warm end and cold end heat exchangers in the cold box, the refrigerant line means including a vapor line and a liquid line, the improvement comprising:

the cold box not having a phase separator therein;

first and second expansion valves in the cold box, the first expansion valve being disposed outside of the cold end heat exchanger and the second expansion valve being disposed between the warm end and cold end heat exchangers; the vapor line extending through the warm end heat exchanger and cold end heat exchanger, through the first expansion valve, back through the cold and warm end heat exchangers and to the compressor means; the liquid line extending from the phase separation means and through the warm end heat exchanger;

an adjustable flow valve in the cold box disposed between the warm end and cold end heat exchangers and connected directly between the liquid line and vapor line upstream of the second expansion valve; means connected to the adjustable flow valve for adjusting the adjustable flow valve to control the rate of fluid flow therethrough, whereby excess liquid in the liquid line is conveyed to the vapor line and compensated for in the apparatus without using a phase separator in the cold box.

33. The improvement of claim 32, further including means, completely external of the cold box, for connecting the compressor means, aftercooler means and phase separator means to one another.

34. The improvement of claim 33, wherein the connecting means completely external of the cold box is insulated.

35. The improvement of claim 34, wherein the aftercooler means includes means associated therewith for cooling the aftercooler means with ambient air.

36. The improvement of claim 35, wherein the apparatus further includes means for monitoring the temperature, pressure and flow rate of the refrigerant in the refrigerant line means at at least two locations including a first location in the vapor line upstream of the adjustable flow valve and a second location downstream of the second expansion valve.

37. The improvement of claim 36, wherein the apparatus further includes means connected to the adjustable valve means and to the monitoring means for controlling the adjustable valve and thus the rate of flow therethrough as a function of the temperatures, pressures and flow rates sensed by the monitoring means.

* * * * *